US009137609B2

(12) United States Patent
Bruss et al.

(10) Patent No.: US 9,137,609 B2
(45) Date of Patent: Sep. 15, 2015

(54) EARPHONE DEVICE WITH IMPEDANCE CORRECTION UNIT

(75) Inventors: John R. Bruss, St. Paul, MN (US); Douglas K. Hogue, Woodbury, MN (US)

(73) Assignee: Imation Corp., St. Paul, MN (US)

( * ) Notice: Subject to any disclaimer, the term of this patent is extended or adjusted under 35 U.S.C. 154(b) by 525 days.

(21) Appl. No.: 13/560,397

(22) Filed: Jul. 27, 2012

(65) Prior Publication Data

US 2013/0028437 A1 Jan. 31, 2013

Related U.S. Application Data

(60) Provisional application No. 61/513,413, filed on Jul. 29, 2011.

(51) Int. Cl.

| | |
|---|---|
| ***H04R 11/00*** | (2006.01) |
| ***H04R 1/10*** | (2006.01) |
| ***H04R 3/14*** | (2006.01) |

(52) U.S. Cl.

CPC ..... *H04R 11/00* (2013.01); *H04R 1/1008* (2013.01); *H04R 3/14* (2013.01)

(58) Field of Classification Search

CPC .. H04R 1/1008; H04R 1/1016; H04R 1/1041; H04R 1/2819; H04R 11/00; H04R 3/14

USPC ..... 381/74, 98, 99, 101–103, 370, 380, 381/183, 200, 412, 417, 418; 455/575.2, 455/569.1

See application file for complete search history.

(56) References Cited

U.S. PATENT DOCUMENTS

| | | | | |
|---|---|---|---|---|
| 7,634,099 | B2 * | 12/2009 | Harvey et al. | 381/380 |
| 2009/0060245 | A1 * | 3/2009 | Blanchard et al. | 381/345 |

OTHER PUBLICATIONS

Elliott, "Design of Passive Crossover", Oct. 2005.*

* cited by examiner

*Primary Examiner* — Vivian Chin
*Assistant Examiner* — David Ton
(74) *Attorney, Agent, or Firm* — Winthrop & Weinstine, P.A.

(57) ABSTRACT

Various aspects of this disclosure are directed to an earphone device comprising a speaker unit including at least one balanced armature transducer to convert an electrical signal into an acoustic signal. The electrical signal may define a frequency range comprising a first frequency and a second frequency. The earphone device may further comprise an impedance correction unit configured to receive the electrical signal and compliment an impedance of the speaker unit such that a sum of an impedance of the impedance correction unit and the impedance of the speaker unit at the first frequency is substantially similar to a sum of an impedance of the impedance correction unit and the impedance of the speaker unit at the second frequency.

19 Claims, 6 Drawing Sheets

$L = C \times (R_T^3 \times RW)^{1/2}$ $R = (R_W \times R_T) / (R_W + R_T)$

EARPHONE DEVICE WITH IMPEDANCE CORRECTION UNIT

CROSS REFERENCE TO RELATED APPLICATION

The present application claims priority to U.S. Provisional Patent Application No. 61/513,413, filed on Jul. 29, 2011, which is hereby incorporated by reference herein in its entirety.

TECHNICAL FIELD

This disclosure relates to earphone devices and, more particularly, to circuits used to compliment the impedance of the earphone devices to achieve frequency-independent impedance of the earphone device for use with amplifiers at different frequencies.

BACKGROUND

Earphone devices, often referred to as headphones, may include one or more speakers that, when held close to a user's ear, may provide audio input to the user while possibly minimizing the amount of sound that can be heard by others. Examples of such earphone devices include circum-aural earphones, supra-aural earphones, and in-ear earphones. Circum-aural earphones fit around and encompass a user's ears. By encompassing the user's ears, circum-aural earphones may help to attenuate external noise that can interfere with the audio signal provided by the earphone device. However, such circum-aural earphones are typically bigger and heavier than other types of earphones.

Supra-aural earphones, in contrast, are typically positioned on top of a user's ears, rather than fitting around and encompassing the ears. As such, supra-aural earphones tend to be smaller and more lightweight than circum-aural earphones, but typically provide less attenuation of external noise.

In-ear earphones may typically include two types of earphone devices. One type, often referred to as earbuds, are typically positioned in a user's outer ear. Earbuds, while typically providing less attenuation of external noise than other types of earphones, are also typically much smaller and lighter than other types of earphones. The second type of in-ear earphones are typically referred to as canal phones or in-ear monitors. Canal phones may provide very high attenuation of external noise and, like earbuds, are typically much smaller and lighter than other types of earphones. The small, lightweight design of in-ear earphones can make the in-ear earphones highly convenient for use with portable devices, such as portable media players. Similarly, the small, lightweight design can make it convenient for a user to transport the in-ear earphones for use with multiple portable or non-portable devices.

SUMMARY

In general, this disclosure describes circuits and techniques that may be used to compliment the frequency-dependent impedance of transducers (e.g., balanced armature transducers) or crossover units of earphone devices to achieve a substantially uniform impedance of the earphone device with respect to the frequency of an input signal. In particular, this disclosure describes a circuit that can be use to match the output impedance of an amplifier to a transducer or crossover unit that has varying impedance as a function of frequency to achieve a frequency-independent impedance of the earphone device. By achieving frequency-independent impedance in an earphone device, the techniques may enable a more accurate reproduction of the acoustic sound represented by the input signal, and may therefore result in a more desirable listening experience for the user of the earphone device.

In one example, this disclosure describes an earphone device comprising a speaker unit. The speaker unit includes at least one balanced armature transducer to convert an electrical signal into an acoustic signal. The electrical signal defines a frequency range that includes a first frequency and a second frequency. The earphone device further includes an impedance correction unit configured to receive the electrical signal and compliment an impedance of the speaker unit such that a sum of an impedance of the impedance correction unit and the impedance of the speaker unit at the first frequency is substantially similar to a sum of an impedance of the impedance correction unit and the impedance of the speaker unit at the second frequency.

In another example, this disclosure describes an earphone device comprising a first speaker unit corresponding to a left channel and a second speaker unit corresponding to a right channel. The first speaker unit includes a first balanced armature transducer and a second balanced armature transducer to convert an electrical signal into an acoustic signal. The second speaker unit includes a third balanced armature transducer and a fourth balanced armature transducer to convert an electrical signal into an acoustic signal. The earphone device further comprises a crossover unit configured to convert the electrical signal into a first component of the electrical signal comprising a first frequency range and a second component of the electrical signal comprising a second frequency range. The earphone device also comprises a plug that interfaces with an amplifier, a first wire corresponding to the left channel that couples the crossover unit to the plug, a second wire corresponding to the right channel that couples the crossover unit to the plug, a third wire and a fourth wire that couple the first speaker unit to the crossover unit, and a fifth wire and a sixth wire that couple the second speaker unit to the crossover unit. The first and second wires are mechanically coupled to form a Y-junction of the wires, and the crossover unit is positioned at or near the Y-junction of the wires.

In another example, this disclosure describes a system comprising an amplifier device configured to output an electrical signal and an earphone device. The earphone device comprises a first speaker unit corresponding to a left channel and a second speaker unit corresponding to a right channel. The first speaker unit includes a first balanced armature transducer and a second balanced armature transducer to convert an electrical signal into an acoustic signal. The second speaker unit includes a third balanced armature transducer and a fourth balanced armature transducer to convert an electrical signal into an acoustic signal. The earphone device further comprises an impedance correction unit. The impedance correction unit is configured to receive the electrical signal that defines a frequency range including a first frequency and a second frequency, compliment an impedance of the first speaker unit such that a sum of an impedance of the impedance correction unit and the impedance of the first speaker unit at the first frequency is substantially similar to a sum of an impedance of the impedance correction unit and the impedance of the first speaker unit at the second frequency, and compliment an impedance of the second speaker unit such that sum of an impedance of the impedance correction unit and the impedance of the second speaker unit at the first frequency is substantially similar to a sum of an impedance of the impedance correction unit and the impedance of the first speaker unit at the second frequency. The system further comprises a crossover unit configured to convert the electrical signal into a first component of the electrical signal comprising a first frequency range and a second component of the electrical signal comprising a second frequency range, a plug that interfaces with the amplifier, a first wire corresponding to the left channel that couples the crossover unit to the plug, a second wire corresponding to the right channel that couples the crossover unit to the plug, a third wire and a fourth wire that couple the first speaker unit to the crossover unit, and a fifth wire and a sixth wire that couple the second speaker unit to the crossover unit. The first and second wires are mechanically coupled to form a Y-junction of the wires, and the crossover unit is positioned at or near the Y-junction of the wires.

The details of one or more examples of this disclosure are set forth in the accompanying drawings and the description below. Other features, objects, and advantages associated with the examples will be apparent from the description and drawings, and from the claims.

DETAILED DESCRIPTION

Figure 1:
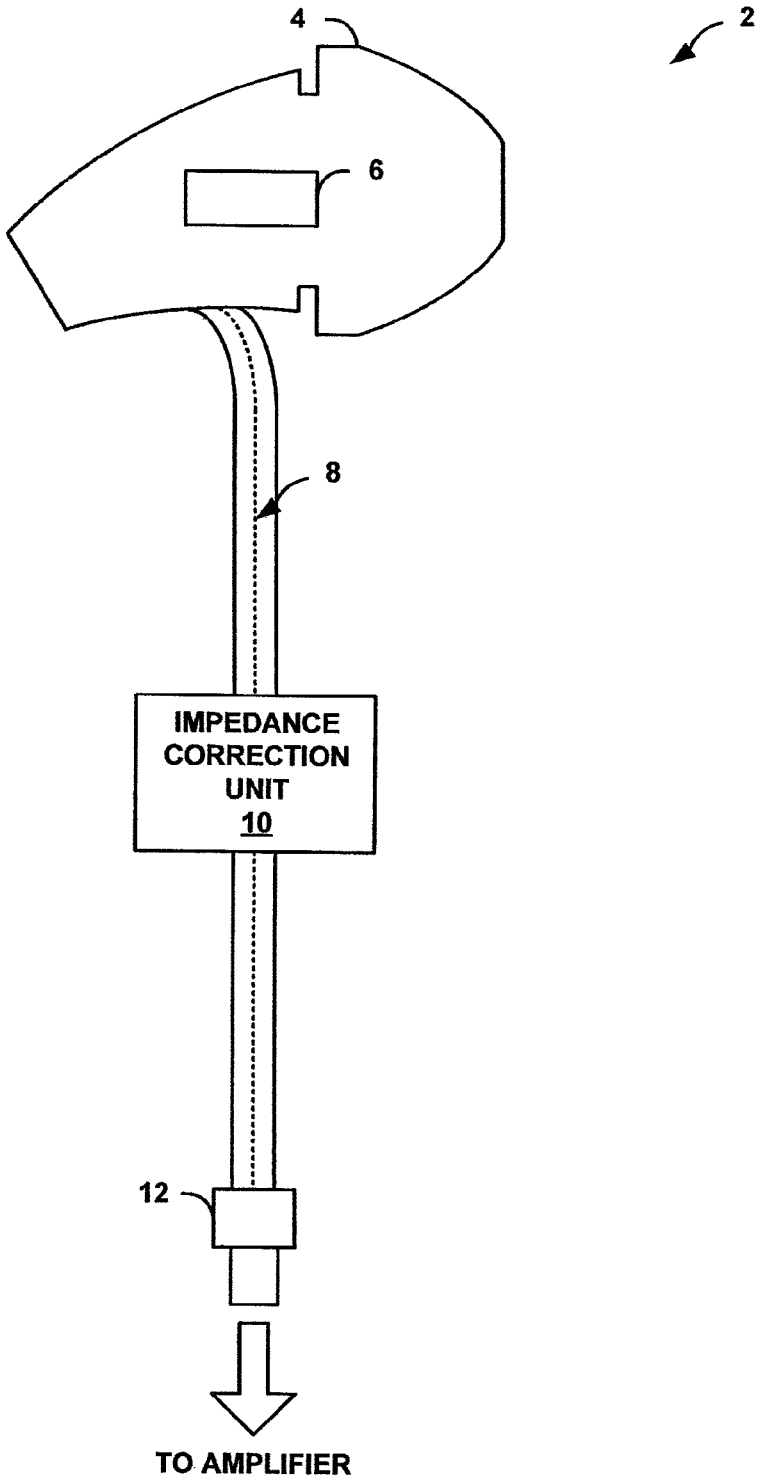
FIG. 1 is a block diagram of an earphone device according to one example of this disclosure.

This disclosure describes circuits and techniques that may be used to ensure substantially uniform impedance between an amplifier and an earphone device regardless of the frequency of the input signal delivered by the amplifier to the earphone device. Earphone devices, when held close to a user's ear, may provide audio input in the form of acoustic sound to the user. Earphone devices typically include one or more transducers that convert an electrical signal provided by an input device (e.g., an amplifier device, portable media player, radio, compact disc (CD) player, computer, and the like) into an acoustic signal. However, some transducers have frequency-dependent impedance, meaning that the impedance of the transducer circuit changes as a function of frequency of the input signal.

In some examples, earphone devices may include one or more balanced armature transducers, which are one type of transducer that can exhibit frequency-dependent impedance. This issue of frequency-dependent impedance may manifest specifically when balanced armature transducers are driven by voltage amplifiers, rather than conventional current amplifiers commonly used with balanced armature transducers. Indeed, the design of a balanced armature transducer may provide an electrically efficient way of converting electrical energy into acoustic output. However, balanced armature transducers typically display a highly inductive load. Due to this highly inductive load associated with balanced armature transducers, the impedance of the balanced armature transducers can vary as a function of the frequency of the electrical signal provided to the transducer, particularly when the electrical signal is provided from a voltage amplifier.

In some examples, an input device to which the earphone device is coupled may include a voltage amplifier. In this case, if the output impedance of the amplifier is high relative to the impedance of the earphone device, the lack of impedance-match between the earphone device and the amplifier may cause a significant change to the frequency response of the earphone device. In such cases, the acoustic signal produced by the earphone device can be degraded.

One solution to ensure an impedance match between an output circuit (i.e., the amplifier) and the input circuit (i.e., the earphone device) is to include an impedance correction unit within the earphone device. The impedance correction unit may be configured to compliment an impedance of a speaker unit of the earphone device so as to provide substantially uniform impedance regardless of the frequency range of a signal delivered by the amplifier. One example of such an impedance correction unit may include a Zobel network circuit. As is discussed in greater detail below, a Zobel network circuit may be included within the earphone device in order to compliment an impedance of the speaker unit so as to ensure a frequency-independent impedance of the earphone device, regardless of the frequency of a signal provided by the amplifier. The Zobel network may compliment an impedance of the speaker unit such that a sum of the impedance of the Zobel network and the impedance of a speaker unit at a first frequency of the input signal is substantially similar to a sum of an impedance of the impedance correction unit and the impedance of the speaker unit at a second frequency of the input signal. Thus, the Zobel network may provide different impedance corrections as a function of the frequency of the input, and may do so in a way that complements the impedance of the speaker unit.

FIG. 1 is a block diagram of an exemplary earphone device 2, in accordance with one or more aspects of this disclosure. Earphone device 2 may include one or more of a speaker unit 4, an impedance correction unit 10, a plug 12, and a wire 8 that couples plug 10 and speaker unit 4 to impedance correction unit 10. In some examples, earphone device 2 may not include all aspects illustrated in FIG. 1. For instance, earphone device 2 may not include plug 12, as when earphone device 2 is configured such that wire 8 couples impedance correction unit 10 directly to an input device, such as a portable media player or amplifier device.

Speaker unit 4 may include various elements, such as one or more transducers that convert electrical signals into acoustic output signals. As illustrated in FIG. 1, consistent with this disclosure, speaker unit 4 includes at least one balanced armature transducer 6. Examples of speaker unit 4 may include earphone speaker devices such as circum-aural earphones, supra-aural earphones, and in-ear earphones. In the illustrated example of FIG. 1, however, speaker unit 4 comprises an in-ear speaker unit (sometimes referred to as an in-ear monitor) configured to be positioned within the ear canal of a user. In other examples, speaker unit 4 may comprise an in-ear speaker unit (sometimes referred to as an earbud) that is typically positioned within the outer ear of a user.

Speaker unit 4 may include one or more transducers, such as one or more balanced armature transducers, to convert an electrical signal into an acoustic output signal. In the illustrated example of FIG. 1, speaker unit 4 includes a balanced armature transducer 6. However, as discussed in greater detail below, in other examples, speaker unit 4 may include multiple balanced armature transducers.

Wire 8 couples speaker unit 4 to impedance correction unit 10. Similarly, wire 8 couples impedance correction unit 10 to plug 12. In examples where speaker unit 4 includes multiple balanced armature transducers, earphone device 2 may include multiple wires that couple speaker unit 4 to impedance correction unit 10. For instance, speaker unit 4 may include two balanced armature transducers. In such case, earphone device 2 may include two wires that couple speaker unit 4 to impedance correction unit 10. Plug 12 may be configured to couple earphone device 2 to an input device, such as an amplifier device. Plug 12 may include various types of analog audio connectors. Examples of plug 12 may include, but are not limited to, quarter-inch, three and one half millimeter, and two and one half millimeter tip, ring, sleeve (TRS), tip, sleeve (TS) connectors, and tip, ring, ring, sleeve (TRRS) connectors.

In some examples, plug 12 may be configured to couple earphone device 2 to an input device, such as a portable media player, MP3 player, CD player, radio, laptop computer, desktop computer, or any device capable of delivering audio input to speaker units. In such examples, the input device may include an amplifier device that defines an output impedance. As described above, because the input impedance of balanced armature transducer 6 varies with respect to the frequency of an input signal, the output impedance of an amplifier may not match with the frequency-varying impedance of balanced armature transducer 6 at some frequencies. This lack of impedance match between the amplifier and balanced armature transducer 6 may affect the acoustic signal reproduced by balanced armature transducer 6, and therefore, may affect the sound output of speaker unit 4. Such lack of impedance match between the amplifier and the balanced armature transducer 6 may result in an undesirable reproduction of the audio signal.

Impedance correction unit 10 may be positioned between the input device and balanced armature transducer 6 to compliment the impedance of balanced armature transducer 6 so as to ensure an impedance that is substantially frequency-neutral (i.e., an impedance that does not vary with respect to the frequency of an input signal). For instance, in examples where balanced armature transducer 6 defines a low impedance at low frequencies and a high impedance at high frequencies, impedance correction unit 10 may be configured to define a high impedance at low frequencies and a low impedance at high frequencies. Similarly, as the impedance of each of impedance correction unit 10 and balanced armature transducer 6 may be represented as functions that are continuous with respect to frequency, impedance correction unit 10 may be configured such that the function that represents the frequency response of the impedance of impedance correction unit 10 compliments the function that represents the frequency response of balanced armature transducer 6. As such, the sum of the impedances of impedance correction unit 10 and balanced armature transducer 6 (as seen from an input device such as an amplifier) may be substantially uniform with respect to a frequency range as defined by the electrical input signal.

Impedance correction unit 10 may include one or more circuits, such as one or more Zobel network circuits. For instance, in examples where speaker unit 4 includes multiple balanced armature transducers (as in the example of FIG. 2 described below), impedance correction unit 10 may include a corresponding number of Zobel network circuits to compliment the impedance of each of the balanced armature transducers. Impedance correction unit 10 may be positioned at any point between the input signal and balanced armature transducer 6. As one example, impedance correction unit 10 may be positioned within speaker unit 4. However, in certain examples, it may be advantageous to position impedance correction unit 10 outside of speaker unit 4. For instance, as in the example of FIG. 1, earphone device 2 may comprise an in-ear earphone device. In such an example, it may be desirable to minimize the size and weight of the speaker unit 4 so as to enhance the comfort for a user that inserts a portion of speaker unit 4 in his or her outer ear canal. As such, it may be advantageous in such examples, to position impedance correction unit 10 outside of speaker unit 4, e.g., along wire 8 or within plug 12. For instance, impedance correction unit 10 may be positioned on a printed circuit board anywhere along wire 8. In some examples, other electronic components such as those to increase the volume of the audio signal reproduced by speaker unit 4 may be positioned along wire 8. In such examples, it may be advantageous to position impedance correction unit 10 at or near such existing electronic components. Similarly, impedance correction unit 10 may be positioned on a printed circuit board, or mounted with existing electronic components within plug 12.

Figure 2:
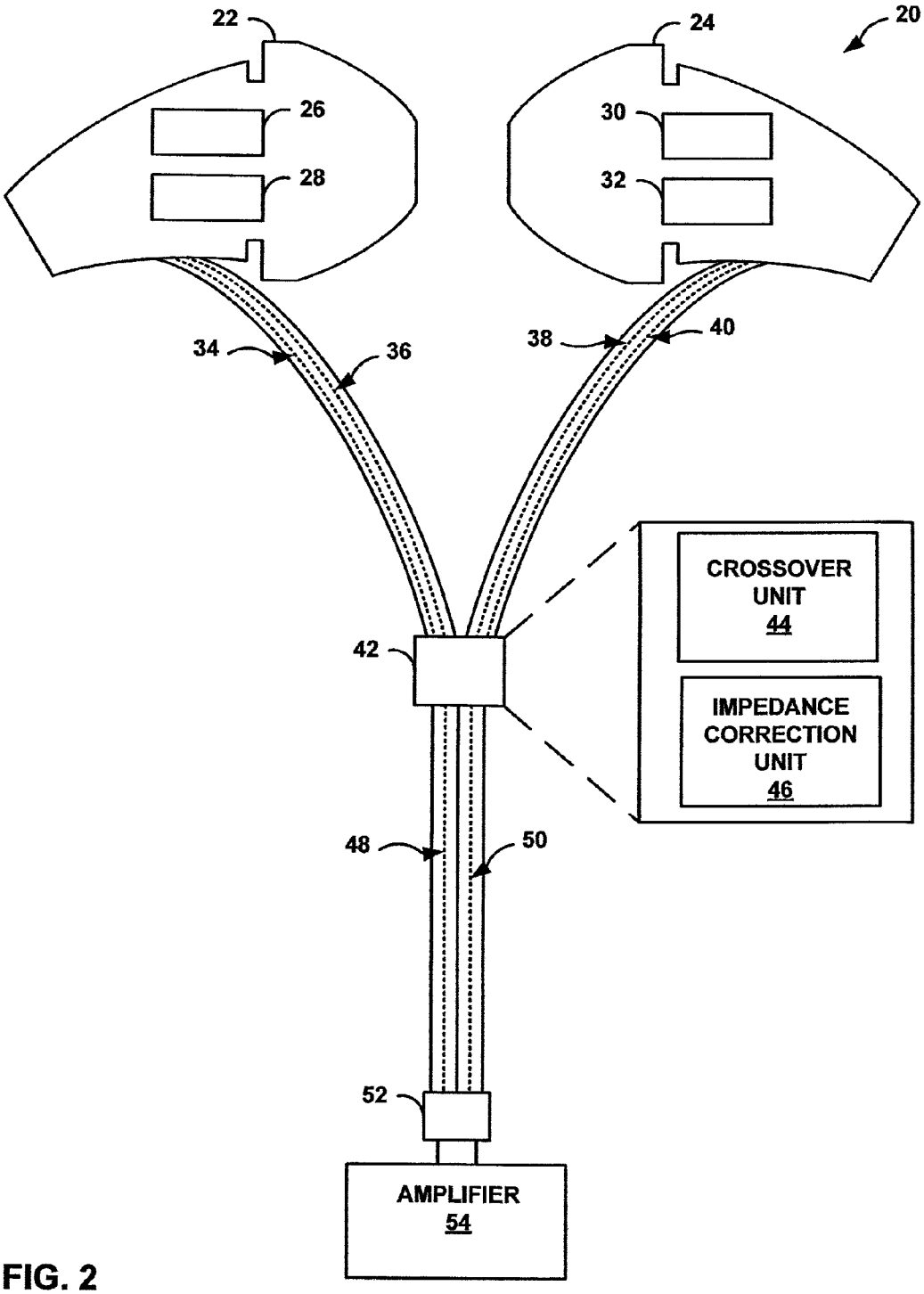
FIG. 2 is a block diagram illustrating an audio system according to an example of this disclosure.

FIG. 2 is a block diagram illustrating one example of an audio system 20, in accordance with one or more aspects of this disclosure. Audio system 20 may include amplifier 54 and an earphone device coupled to amplifier 54. The earphone device may include one or more of left speaker unit 22, right speaker unit 24, and plug 52. In addition, the earphone device may include one or more of a left channel wire 48 and a right channel wire 50. As illustrated in FIG. 2, left channel wire 48 and right channel wire 50 may be mechanically coupled to form a Y-junction 42. The earphone device may further include one or more of a crossover unit 44 and an impedance correction unit 46. In the example of FIG. 2, crossover unit 44 and impedance correction unit 46 are positioned at Y-junction 42. High frequency wire 34 and low frequency wire 36 may couple left speaker unit 22 to crossover unit 44. Similarly, high frequency wire 40 and low frequency wire 38 may couple right speaker unit 24 to crossover unit 44. Left speaker unit 22 and right speaker unit 24 may include one or more balanced armature transducers to convert an electrical signal into an acoustic signal. In the example of FIG. 2, left speaker unit 22 includes high frequency balanced armature transducer 26 and low frequency balanced armature transducer 28. Similarly, right speaker unit 24 includes high frequency balanced armature transducer 30 and low frequency balanced armature transducer 32.

Plug 52 may be configured to couple the earphone device to amplifier 54. Amplifier 54 may output one or more electrical signals that correspond to one or more acoustic signals. As in FIG. 2, amplifier 54 may output an electrical signal corresponding to a left channel and another electrical signal corresponding to a right channel. As discussed above, amplifier 54 may define an output impedance. The inductive nature of balanced armature transducers 26, 28, 30, and 32 may cause left speaker unit 22 and right speaker unit 24 to define an input impedance that varies as a function of the frequency of an input signal to the transducers within speaker unit 22 and 24. In such examples where the output impedance of amplifier 54 is high relative to the input impedance of speaker units 22 and 24, the output impedance of amplifier 54 may not match the frequency-varying input impedance of speaker units 22 and 24 at some frequencies. In such examples, the acoustic signal reproduced by speaker units 22 and 24 may not accurately represent the acoustic signal output by amplifier 54, and may result in an undesirable listening experience for a user of audio system 20. As discussed above, one solution may be achieved by an impedance correction unit, such as impedance correction unit 46, positioned between amplifier 54 and speaker units 22 and 24.

In certain examples, impedance correction unit 46 may include one or more Zobel network circuits. The Zobel network circuit may be configured to compliment an impedance of speaker units 22 and 24, such that the sum of the impedance of the Zobel network circuit and the impedance of speaker units 22 and 24 is substantially uniform with respect to a frequency range of the electrical signals output by amplifier 54. As discussed above, amplifier 54 may output one or more electrical signals corresponding to an acoustic signal. As in FIG. 2, amplifier 54 may output an electrical signal corresponding to a left channel and an electrical signal corresponding to a right channel. Each of the left channel signal and right channel signal output by amplifier 54 define a range of frequencies corresponding to the audio output to be produced. For instance, each of the left and right channel signals may comprise voltage signals modulated with an analog waveform of low frequency and high frequency components of the corresponding audio signal. As one example, impedance correction unit 46 (e.g., one or more Zobel network circuits) may be configured such that the sum of the impedance of impedance correction unit 46 and the impedance of left speaker unit 22 is substantially uniform regardless of the frequency range of the left channel signal. Similarly, impedance correction unit 46 may be configured such that the sum of the impedance of impedance correction unit 46 and the impedance of right speaker unit 22 is substantially uniform regardless of the frequency range of the right channel signal.

In certain examples, each of left speaker unit 22 and right speaker unit 24 may include multiple balanced armature transducers. The balanced armature transducers may each be configured to be responsive to a defined frequency range. For instance, a typical signal output by amplifier 54 may include a range of frequencies that corresponds to the range of frequencies audible by the human ear. The multiple balanced armature transducers may each be configured to be responsive to a range of frequencies included in the signal that is output by amplifier 54. As in the example of FIG. 2, left speaker unit 22 includes high frequency balanced armature transducer 26 (sometimes referred to as a tweeter) and low frequency balanced armature transducer 28 (sometimes referred to as a woofer). High frequency balanced armature transducer 26 may be configured to be responsive to a range of frequencies that corresponds to a higher range of the audible frequency range than low frequency balanced armature transducer 28. In some examples, the low frequency range and the high frequency range may be mutually exclusive, such that the lowest frequency of the high frequency range is higher than the highest frequency of the low frequency range. In other examples, the low frequency range and the high frequency range may overlap to some extent, such that the highest frequency of the high frequency range is higher than the highest frequency of the low frequency range and the lowest frequency of the low frequency range is lower than the lowest frequency of the high frequency range, but the highest frequency of the low frequency range is higher than the lowest frequency of the high frequency range.

In examples where one or more of left speaker unit 22 and right speaker unit 24 include multiple balanced armature transducers configured to be responsive to defined frequency ranges, it can be advantageous to include a crossover unit in the earphone device. In this case, the crossover unit may be configured to convert the electrical signal received from amplifier 54 into separate components of the electrical signal comprising the defined frequency ranges. As shown in FIG. 2, for example, earphone device 20 includes crossover unit 44. In some examples, crossover unit 44 may include one or more crossover circuits configured to convert the left channel signal received from amplifier 54 into a high frequency signal component that includes the high frequencies output by high frequency balanced armature transducer 26 and into a low frequency signal component that includes the low frequencies output by low frequency balanced armature transducer 28. Similarly, crossover unit 44 may include one or more crossover circuits configured to convert the right channel signal received from amplifier 54 into a high frequency signal component that includes the high frequencies output by high frequency balanced armature transducer 30 and into a low frequency signal component that includes the low frequencies output by low frequency balanced armature transducer 32.

In other examples, such as when one or more of left speaker unit 22 or right speaker unit 24 includes more than two balanced armature transducers configured to be responsive to defined frequency ranges; crossover unit 44 may be configured to convert one or more of the left channel signals or right channel signals received from amplifier 54 into a number of different components of the electrical signals corresponding to the respective frequency ranges of different transducers. For instance, when left speaker unit 22 includes three balanced armature transducers configured to be responsive to a low, mid, and high range of frequencies, crossover unit 44 may be configured to convert the left channel signal received from amplifier 54 into three components of the electrical signal corresponding to the low, mid, and high frequency ranges of the three balanced armature transducers of left speaker unit 22.

In certain examples, crossover unit 44 may include a crossover circuit configured to convert both the left and right channel signals received from amplifier 54 into components of the electrical signals that include the audio signals at defined frequency ranges associated with low frequency balanced armature transducers 28 and 32 and the high frequency balanced armature transducers 26 and 30. In other examples, crossover unit 44 may include multiple crossover circuits configured to convert signals received from amplifier 54 (e.g., a left channel signal) into a specific frequency range (e.g., a low frequency range) corresponding to a frequency range of a balanced armature transducer of one or more of speaker units 22 and 24. For instance, crossover unit 44 may include a crossover circuit configured to convert a left channel signal received from amplifier 54 into components of the electrical signal that include a high frequency range of audio signals associated with high frequency balanced armature transducer 26 and a low frequency range of audio signals associated with low frequency balanced armature transducer 28. Similarly, crossover unit 44 may include a separate crossover circuit configured to convert a right channel signal received from amplifier 54 into components of the electrical signal that include a high frequency range associated with high frequency balanced armature transducer 30 and a low frequency range associated with low frequency balanced armature transducer 32.

Crossover unit 44 may be positioned between amplifier 54 and balanced armature transducers 26, 28, 30 and 32. For example, crossover unit 44 may be positioned at any point along left channel wire 48 and right channel wire 50. In another example, crossover unit 44 may be located within speaker units 22 and 24, although this could result in undesirable size and weight in speaker unit 22 and 24. In the example where crossover unit 44 includes multiple crossover circuits, one crossover circuit may be configured to convert the left channel signal received from amplifier 54 into a component of the electrical signal comprising the frequency range of high frequency balanced armature transducer 26 and another crossover circuit may be configured to convert the same signal from amplifier 54 into a component of the electrical signal comprising the frequency range of low frequency balanced armature transducer 28. Similarly, a crossover unit may be configured to convert the right channel signal received from amplifier 54 into a component of the electrical signal comprising the frequency range of high frequency balanced armature transducer 30 and to convert the same signal from amplifier 54 into a component of the electrical signal comprising the frequency range of low frequency balanced armature transducer 32. In examples where the crossover circuits are located outside of the respective speaker units 22 and 24, high frequency wires 34 and 40 and low frequency wires 36 and 38 may be needed to send the respective high frequency and low frequency signals to the respective balanced armature transducers 26, 28, 30 and 32.

In the specific example of FIG. 2, where speaker units 22 and 24 comprise in-ear speaker units such that at least a portion of the speaker units 22 and 24 are configured to be inserted in the outer ear canal of a user, it may be particularly advantageous to position crossover unit 44 outside of speaker units 22 and 24. For instance, positioning of crossover unit 44 outside of speaker units 22 and 24 may enable the speaker units to be designed in a more lightweight and compact manner, possibly improving the form factor of the speaker units for positioning in the outer ear canals of a user. Similarly, positioning crossover unit 44 remotely from speaker units 22 and 24 may enable crossover unit 44 to include more complex electronic components for performing crossover functions, because issues otherwise associated with size and weight considerations of in-ear speaker units may be avoided. As such, positioning crossover unit 44 remotely from speaker units 22 and 24 may enable crossover unit 44 to perform the crossover functions more accurately by eliminating size and weight constraints.

As illustrated in FIG. 2, crossover unit 44 may be positioned at Y-junction 42. In some examples, Y-junction 42 may include an electronics housing, which may include other electronic components, such as electronic components for modifying the volume (or other characteristics) of the audio signal reproduced by speaker units 22 and 24. In such examples, it may be convenient to position crossover circuit 44 within the existing electronics housing at Y-junction 42. However, in contrast to an example where the crossover circuits are positioned within speaker units 22 and 24, the example of FIG. 2 may require that high frequency wires 34 and 40 and low frequency wires 36 and 38 for each channel.

In different examples, impedance correction unit 46 may be positioned anywhere between amplifier 54 and speaker units 22 and 24. For instance, in examples where impedance correction unit 46 includes multiple circuits (e.g., multiple Zobel network circuits), an impedance correction circuit configured to compliment an impedance of left speaker unit 22 may be positioned within speaker unit 22. Similarly, an impedance correction circuit configured to compliment an impedance of right speaker unit 24 may be positioned within speaker unit 24. Again, however, it may be more desirable to position the impedance correction circuits outside of the respective speaker units.

By positioning impedance correction unit 46 remotely from speaker units 22 and 24, speaker units 22 and 24 may be designed in a more lightweight and compact fashion, thereby enhancing the comfort for a user. In various examples, impedance correction unit may be positioned at any point along left channel wire 48 and right channel wire 50. In one example, impendence correction circuit 46 may be located within plug 52, or in another example (as shown in FIG. 2), impendence correction circuit 46 may be located at Y-junction 42. Y-junction 42 may comprise the point along the left and right speaker wires where such wires physically attach in one direction and physically detach in the other direction.

In some examples, impedance correction unit 46 may be positioned between crossover unit 44 and speaker units 22 and 24. In one example, crossover unit 44 may be positioned at Y-junction 42, and impedance correction circuits may be positioned within speaker units 22 and 24. Again, however, because crossover unit 44 typically increases the number of electrical signals received from amplifier 54 (e.g., by converting an electrical signal comprising a frequency range into multiple electrical signals each comprising a defined frequency sub-range), it may be advantageous to position impedance correction unit 46 outside of the speaker units, e.g., between amplifier 54 and crossover unit 44. For instance, in examples, where impedance correction unit 46 is positioned between crossover unit 44 and speaker units 22 and 24, impedance correction unit 46 may include a number of impedance correction circuits corresponding to the number of electrical signals that are output from crossover unit 44. For example, if crossover unit 44 converts a left channel electrical signal received from amplifier 54 into two components of the electrical signal (e.g., a low frequency component of the electrical signal and a high frequency component of the electrical signal), impedance correction unit 46 may include two impedance correction circuits (e.g., an impedance correction circuit corresponding to the low frequency component of the electrical signal and an impedance correction circuit corresponding to the high frequency component of the electrical signal). As such, in examples where impedance correction unit 46 is positioned between amplifier 54 and crossover unit 44, impedance correction unit 46 may include fewer electrical components than would be the case if impedance correction unit 46 is positioned after crossover unit 44.

For reasons similar to those explained above with respect to crossover unit 44, it may be advantageous to position impedance correction unit 46 at Y-junction 42. In this case, crossover unit 44 may be positioned within an existing electronics housing positioned at Y-junction 42. Similarly, in examples where crossover unit 44 is positioned at Y-junction 42, it may be convenient to position impedance correction unit 46 within the same electronics housing or on a printed circuit board associated with crossover unit 44.

Figure 3:
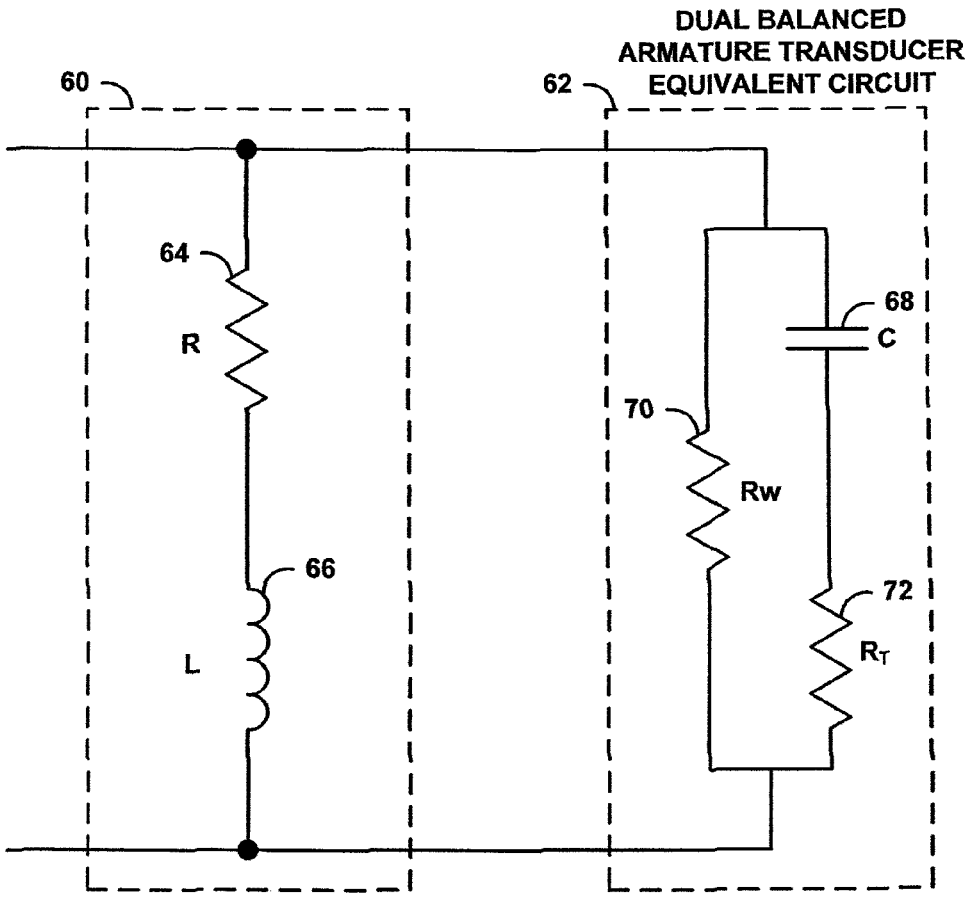
FIG. 3 is a circuit diagram illustrating an example impedance correction circuit according to this disclosure.

FIG. 3 is a circuit diagram illustrating an example impedance correction circuit, in accordance with one or more aspects of this disclosure. In the example of FIG. 3, the impedance correction circuit comprises a Zobel network circuit including a Zobel bridge 60 and a dual balanced armature transducer equivalent circuit 62. Dual balanced armature transducer equivalent circuit 62 includes a capacitor 68, a resistor 70, and a resistor 72 that collectively model the portion of the speaker that has frequency dependent impedance. Zobel bridge 60 includes a resistor 64 and an inductor 66. Again, dual balanced armature transducer equivalent circuit 62 may be used to model the impedance of a speaker unit including two balanced armature transducers, such as left speaker unit 22 or right speaker unit 24 of FIG. 2. Because dual balanced armature transducer equivalent circuit 62 is a model of the portion of a speaker unit that has frequency dependent impedance, capacitor 68, resistor 70, and resistor 72 may only represent a portion of the entire speaker unit. The capacitance of capacitor 68 (i.e., C), resistance of resistor 70 (i.e., $R_W$), and resistance of resistor 72 (i.e., $R_T$) may be determined, such as by measuring the response of a speaker unit (e.g., speaker unit 22) into a fixed resistive load and by determining the values of capacitance of capacitor 68, resistance of resistor 70, and resistance of resistor 72 to match such a response.

The values of resistor 64 and inductor 66 may be defined for Zobel bridge 60 so as to compliment the inductance of dual balanced armature transducer equivalent circuit 62. Moreover, the values of resistor 64 and inductor 66 may be selected to complement changing inductance of dual balanced armature transducer equivalent circuit 62 at different frequencies. The values of resistor 64 and inductor 66 may be fixed in any given scenario, but could be tunable so that Zobel bridge 60 can be tuned for use in different speaker applications.

Resistor 64 may be configured such that the resistance of resistor 64 (i.e., R) satisfies the formula:

$$R=(R_W \times R_T)/(R_W+R_T)$$

where $R_W$ is the resistance of resistor 70 and $R_T$ is the resistance of resistor 72 of dual balanced armature transducer equivalent circuit 62. Inductor 66 may be configured such that the inductance of inductor 66 satisfies the following formula:

$$L=C\times(R_T^3\times R_W)^{1/2}$$

where C is the capacitance of capacitor 68, $R_T$ is the resistance of resistor 72, and $R_W$ is the resistance of resistor 70 of dual balanced armature transducer equivalent circuit 62. As such, Zobel bridge 60 may be introduced and configured to compliment the impedance of dual balanced armature transducer equivalent circuit 62 such that the sum of the impedance of dual balanced armature transducer equivalent circuit 62 and Zobel bridge 60 is not dependent upon the frequency of an input signal.

Figure 4:
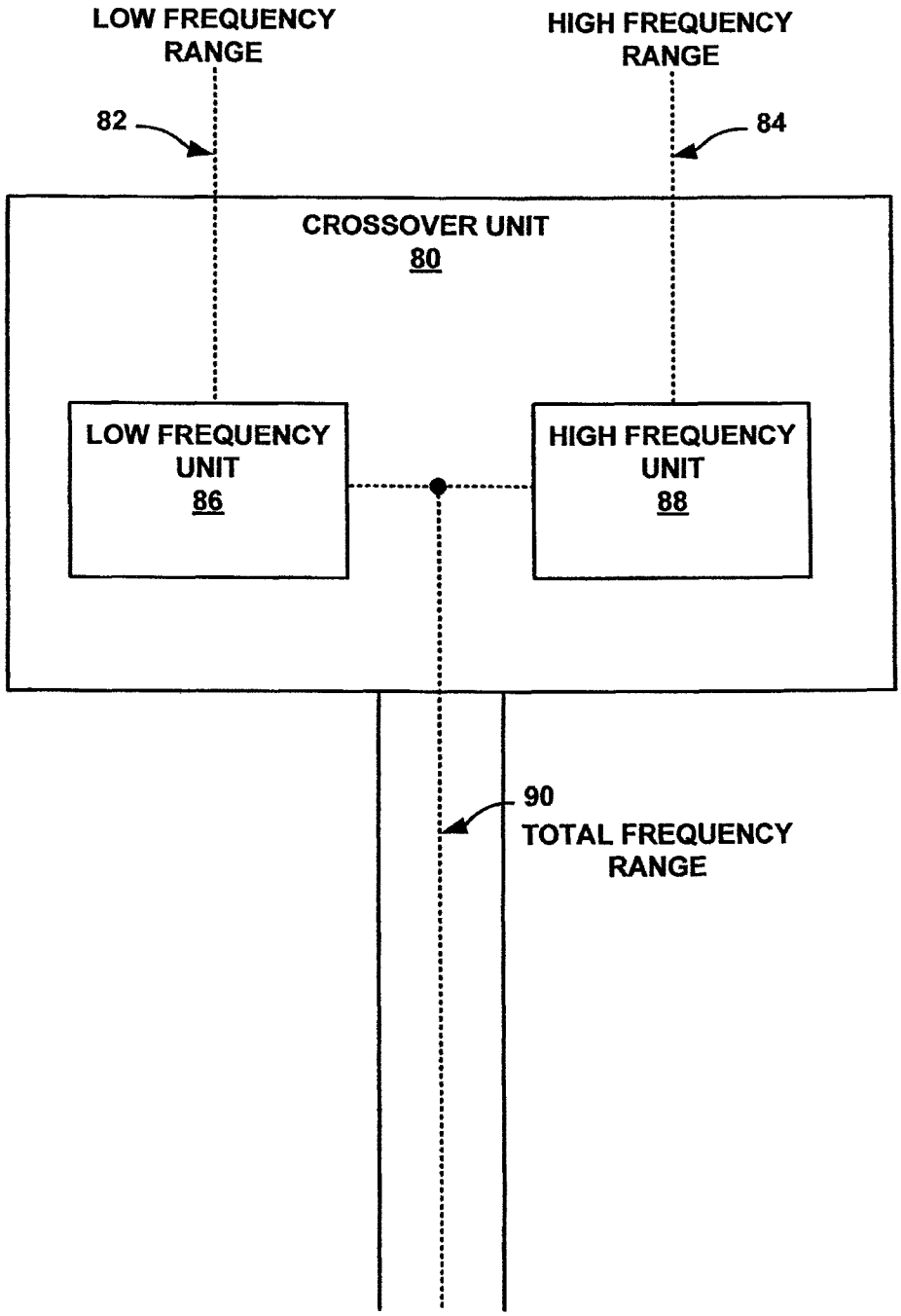
FIG. 4 is a block diagram of an example crossover unit according to this disclosure.

FIG. 4 is a block diagram of an example crossover unit 80, which may correspond to crossover unit 44 of FIG. 2. As illustrated in FIG. 4, crossover unit 80 may include low frequency unit 86 and high frequency unit 88. Crossover unit 80 may be configured to receive an electrical signal 90, such as a left channel or right channel signal received from amplifier 54 of FIG. 2. Electrical signal 90 may include a composition of frequency components representing a total range of frequencies. Crossover unit 80 may deliver electrical signal 90 to low frequency unit 86 and high frequency unit 88. Low frequency unit 86 may convert electrical signal 90 into a low frequency electrical signal component 82. High frequency unit 88 may convert electrical signal 90 into a high frequency electrical signal component 84. As such, crossover unit 80 may be configured to receive an electrical signal, and to convert the electrical signal into a first component of the electrical signal comprising a first audio frequency range (e.g., a low frequency range) and a second component of the electrical signal comprising a second audio frequency range (e.g., a high frequency range). Crossover unit 80 may be implemented via one or more highpass filters and one or more lowpass filters configured to filter the input signal in two different ways to produce low frequency electrical signal component 82 and high frequency electrical signal component 84. However, any type of crossover circuits or techniques could be used.

In some examples, crossover unit 80 may comprise a crossover circuit, such that low frequency unit 86 and high frequency unit 88 comprise a common circuit configured to convert electrical signal 90 into low frequency electrical signal component 82 and high frequency electrical signal component 84. In other examples, crossover unit 80 may comprise multiple crossover circuits. In different examples, crossover unit 80 may be positioned on a common circuit board, or may be distributed among multiple circuit boards that may be physically remote. One or more of low frequency unit 86 and high frequency unit 88 may represent one or more passive electrical components (e.g., capacitors, resistors, inductors, filters, and the like), active electrical components (i.e., amplifiers, or other electrical components that receive electrical input and possibly provide gain to the signal), or both active and passive components. In certain examples, one or more components of low frequency unit 86 and high frequency unit 88 may be implemented in software or firmware executing on a processor, such as a microprocessor, a controller, a digital signal processor (DSP), an application specific integrated circuit (ASIC), a field-programmable gate array (FPGA), or equivalent discrete or integrated logic circuitry.

As one example, low frequency unit 86 may include a low-pass filter that allows low frequency components of a signal to pass, but attenuates frequency components higher than a cutoff frequency. As such, low frequency unit 86 may be configured to convert electrical signal 90 into low frequency signal component 82 by attenuating those frequency components of electrical signal 90 that are higher than a cutoff frequency. In this case, low frequency unit 86 may attenuate the high frequencies. As another example, low frequency unit 86 may include a band-pass filter that attenuates frequencies outside a defined range (i.e., below a minimum cutoff frequency and above a maximum cutoff frequency). As such, low frequency unit 86 may be configured to convert electrical signal 90 into low frequency signal component 82 by attenuating frequencies below a minimum frequency and above a maximum frequency to which a low frequency balanced armature transducer is configured to be responsive.

In some examples, high frequency unit 88 may include a high pass filter that attenuates frequency components of electrical signal 90 that are below a minimum cutoff frequency. Alternatively, high frequency unit 88 may include a band pass filter that attenuates frequency components of electrical signal 90 that are outside the range of frequencies to which a high frequency balanced armature transducer is configured to be responsive.

Figure 5:
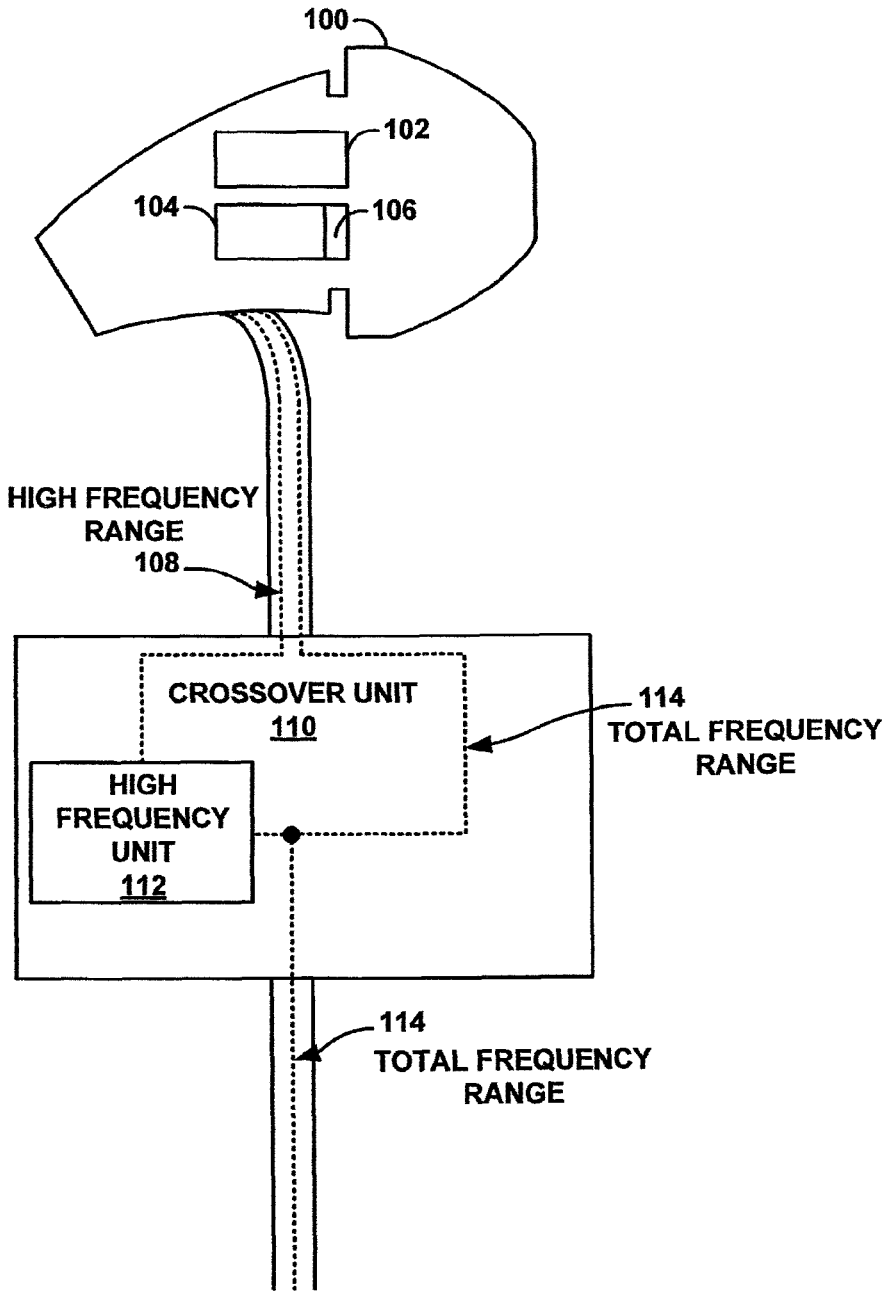
FIG. 5 is a block diagram of an earphone device including a crossover unit according to one example of this disclosure.

FIG. 5 is a block diagram of an earphone device including a crossover unit according to one example of this disclosure. As shown in FIG. 5, the earphone device includes a speaker unit 100 and a crossover unit 110. Speaker unit 100 may include various elements, such as one or more transducers that convert electrical signals into acoustic output signals. As illustrated in FIG. 5, speaker unit 100 includes high frequency balanced armature transducer 102 and low frequency balanced armature transducer 104. Low frequency balanced armature transducer 104 includes acoustic low-pass filter 106. Crossover unit 110 includes high frequency unit 112.

As illustrated in FIG. 5, crossover unit 110 may be configured to receive electrical signal 114, such as a left channel or right channel signal received from amplifier 54 of FIG. 2. Electrical signal 114 may include a composition of frequency components representing a total range of frequencies. Crossover unit 110 may deliver electrical signal 114 to high frequency unit 112, which may convert electrical signal 114 into a high frequency electrical signal component 108. For instance, high frequency unit 112 may include one or more of a high-pass filter or band-pass filter implemented in hardware, software, firmware, or any combination thereof. As in the example of FIG. 5, crossover unit 110 may be configured to allow electrical signal 114 (including the total frequency range of the electrical signal) to pass. As such, crossover unit 110 may be configured to convert electrical signal 114 into an electrical signal including a high frequency component and an electrical signal including the total range of frequency components of electrical signal 114.

Crossover unit 110 may deliver electrical signal 114 and high frequency electrical signal component to speaker unit 100. Speaker unit 100 may be configured to deliver high frequency electrical signal component to high frequency balanced armature transducer 102. Similarly, speaker unit 100 may be configured to deliver electrical signal 114 (including the total range of frequency components) to low frequency balanced armature transducer 104. As illustrated in FIG. 5, low frequency balanced armature transducer 104 may include acoustic low-pass filter 106. Acoustic low-pass filter 106 may be an acoustic low-pass filter (e.g., a tuned port passageway) configured to allow low frequency components of a signal to pass, but to attenuate frequency components that are higher than a defined cutoff frequency.

Figure 6:
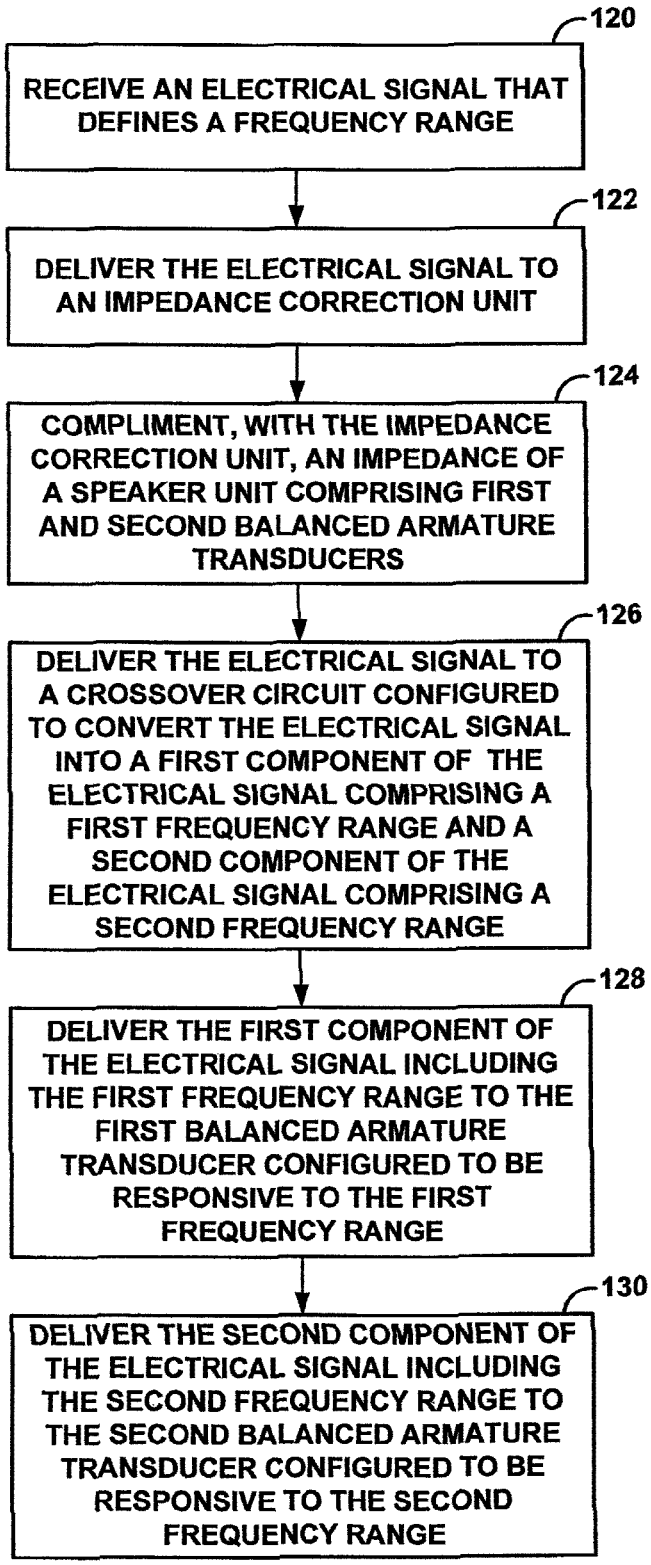
FIG. 6 is a flow diagram illustrating an example method according to this disclosure.

FIG. 6 is a flow diagram illustrating an example method, in accordance with one or more aspects of this disclosure. An earphone device may receive an electrical signal that defines a frequency range (120). For example, plug 52 may be configured to couple the earphone device to amplifier 54. Plug 52 may receive an electrical signal from amplifier 54, such as one or more of a left or right channel signal that includes a composition of analog frequencies that define an electrical representation of an acoustic signal.

Plug 52 may deliver the electrical signal to an impedance correction unit (122). As an example, the earphone device may include one or more of left channel wire 48 and right channel wire 50 that couple plug 52 to impedance correction unit 46. Impedance correction unit 46 may include one or more impedance correction circuits, such as one or more Zobel network circuits.

Impedance correction unit 46 may compliment an impedance of a speaker unit (e.g., one or more of left speaker unit 22 and right speaker unit 24) comprising first and second balanced armature transducers (e.g., high frequency balanced armature transducer 26 and low frequency balanced armature transducer 28) such that a sum of an impedance of the impedance correction unit and the impedance of the speaker unit at a first frequency of the electrical signal is substantially similar to a sum of an impedance of the impedance correction unit and the impedance of the speaker unit at a second frequency of the electrical signal (124). Again, impedance correction unit 46 may include one or more Zobel network circuits specifically to achieve a substantially frequency-independent impedance of the speaker unit (i.e., in combination with the impedance correction circuit). In one example, a resistor and an inductor of a Zobel bridge of the Zobel network circuit may be configured such that the impedance of the sum of the impedance of the Zobel bridge and the impedance of a speaker unit (e.g., left speaker unit 22) is substantially uniform with respect to the frequency range of the electrical signal. In some cases, the values of the impedance correction circuit may be tunable so that the circuit can be tuned for different applications or use with different types of speakers or amplifiers.

Impedance correction unit 46 may deliver the electrical signal to a crossover circuit, which may be configured to convert the electrical signal into a first component of the electrical signal comprising a first frequency range and a second component of the electrical signal comprising a second frequency range (126). As an example, impedance correction unit 46 may deliver the electrical signal to crossover unit 44. Crossover unit 44 may include low frequency unit 86 and high frequency unit 88. Low frequency unit 86 may convert the electrical signal into a low frequency electrical signal component 82. High frequency unit 88 may convert the electrical signal into high frequency electrical signal component 84.

Crossover unit 44 may deliver the first component of the electrical signal including the first frequency range to the first balanced armature transducer configured to be responsive to the first frequency range (128). For instance, left speaker unit 22 may include low frequency balanced armature transducer 28 configured to be responsive to the first frequency range. Crossover unit 44 may also deliver the electrical signal including the first frequency range to low frequency balanced armature transducer 28 using low frequency wire 36.

Crossover unit 44 may deliver the second component of the electrical signal including the second frequency range to the second balanced armature transducer configured to be responsive to the second frequency range (130). For example, left speaker unit 22 may include high frequency balanced armature transducer 26 configured to be responsive to the second frequency range. Crossover unit 44 may deliver the electrical signal including the second frequency range to high frequency balanced armature transducer 26 using high frequency wire 34.

A number of examples have been described. For example, an impedance correction circuit has been described for use in stabilizing the impedance of an earphone device for use with an amplifier when the impedance of the speaker unit changes as a function of frequency of the signal. Many physical arrangements of a speaker unit have also been described, and these arrangements may be used with or without the impedance correction circuit described herein. For example, a crossover circuit may be removed from speaker housings and located along a speaker wire, possibly in the same location as an impedance correction circuit. The Y-junction of speaker wires has been described as one location for such components, although other locations (including the plug) could be used. In some examples, the low pass portion of the crossover unit may be configured as an acoustic filter positioned within the speaker unit. When the crossover is located along the speaker wire (or within the plug), it may be necessary to include multiple wires for each channel between the crossover and speaker units that include multiple transducers (e.g., one wire per transducer). These and other embodiments are within the scope of the following claims.

The invention claimed is:

1. An earphone device, comprising:

a crossover unit configured to convert an electrical signal into a first component comprising a first frequency range and a second component comprising the second frequency range;

a first speaker unit corresponding to one of a left or right channel and including a first balanced armature transducer signal, wherein configured to be responsive to the electrical signal at the first frequency range and a second balanced armature transducer configured to be responsive to the electrical signal at the second frequency range;

a second speaker unit corresponding to the other of the left or right channel and including a third balanced armature transducer configured to be responsive to the electrical signal at the first frequency range, and a fourth balanced armature transducer configured to be responsive to the electrical signal at the second frequency range;

an impedance correction unit configured to:

receive the electrical signal, wherein the electrical signal defines a frequency range comprising a first frequency and a second frequency; and compliment an impedance of the first speaker unit such that a sum of an impedance of the impedance correction unit and the impedance of the first speaker unit at the first frequency is substantially similar to a sum of an impedance of the impedance correction unit and the impedance of the first speaker unit at the second frequency;

a plug that interfaces with an amplifier;

a first wire corresponding to the left channel that couples the crossover unit to the to the plug;

a second wire corresponding to the right channel that couples the crossover unit to the plug;

a third wire and a fourth wire that couple the first speaker unit to the crossover unit; and a fifth wire and a sixth wire that couple the second speaker unit to the crossover unit;

wherein the first and second wires are mechanically coupled to form a Y-junction of the wires, and wherein the crossover unit is positioned at or near the Y-junction of the wires.

2. The earphone device of claim 1, wherein the impedance correction unit comprises a Zobel network circuit.

3. The earphone device of claim 1, wherein the impedance of the first speaker unit at the first frequency is different than the impedance of the first speaker unit at the second frequency, and wherein the impedance of the impedance correction unit at the first frequency is different than the impedance of the impedance correction unit at the second frequency, such that the sum of the impedance of the first speaker unit and the impedance correction unit remains substantially constant over a frequency range.

4. The earphone device of claim 1, wherein the first frequency range comprises a total frequency range of the electrical signal.

5. The earphone device of claim 1, wherein the impedance correction unit is positioned at or near the Y-junction of the wires.

6. The earphone device of claim 1, wherein the impedance correction unit is positioned at or near the plug that interfaces with the amplifier.

7. The earphone device of claim 1, wherein at least a portion of the speaker unit is configured to be inserted within an outer ear of a user.

8. An earphone device, comprising:

a first speaker unit corresponding to a left channel, the first speaker unit including a first balanced armature transducer and a second balanced armature transducer to convert an electrical signal into an acoustic signal;

a second speaker unit corresponding to a right channel, the second speaker unit including a third balanced armature transducer and a fourth balanced armature transducer to convert an electrical signal into an acoustic signal;

a crossover unit configured to convert the electrical signal into a first component of the electrical signal comprising a first frequency range and a second component of the electrical signal comprising a second frequency range;

a plug that interfaces with an amplifier;

a first wire corresponding to the left channel that couples the crossover unit to the plug;

a second wire corresponding to the right channel that couples the crossover unit to the plug;

a third wire and a fourth wire that couple the first speaker unit to the crossover unit; and a fifth wire and a sixth wire that couple the second speaker unit to the crossover unit, wherein the first and second wires are mechanically coupled to form a Y-junction of the wires, and wherein the crossover unit is positioned at or near the Y-junction of the wires.

9. The earphone device of claim 8, wherein at least a portion of the first speaker unit and at least a portion of the second speaker unit are configured to be inserted within an outer ear of a user.

10. The earphone device of claim 8, wherein the first balanced armature transducer and the third balanced armature transducer are configured to be responsive to the electrical signal at the first frequency range, and wherein the second balanced armature transducer and the fourth balanced armature transducer are configured to be responsive to the electrical signal at the second frequency range.

11. The earphone device of claim 8 wherein the first frequency range comprises a total frequency range of the electrical signal.

12. The earphone device of claim 8, further comprising:

an impedance correction unit, wherein the impedance correction unit is configured to:

receive the electrical signal, wherein the electrical signal defines a frequency range comprising a first frequency and a second frequency;

compliment an impedance of the first speaker unit such that a sum of an impedance of the impedance correction unit and the impedance of the first speaker unit at the first frequency is substantially similar to a sum of an impedance of the impedance correction unit and the impedance of the first speaker unit at the second frequency; and compliment an impedance of the second speaker unit such that sum of an impedance of the impedance correction unit and the impedance of the second speaker unit at the first frequency is substantially similar to a sum of an impedance of the impedance correction unit and the impedance of the first speaker unit at the second frequency.

13. The earphone device of claim 12, wherein the impedance correction unit comprises a Zobel network circuit.

14. The earphone device of claim 12, wherein:

the impedance of the first speaker unit at the first frequency is different than the impedance of the first speaker unit at the second frequency, and wherein the impedance of the impedance correction unit at the first frequency is different than the impedance of the impedance correction unit at the second frequency, such that the sum of the impedance of the first speaker unit and the impedance correction unit remains substantially constant over a frequency range; and wherein the impedance of the second speaker unit at the first frequency is different than the impedance of the second speaker unit at the second frequency, and wherein the impedance of the impedance correction unit at the first frequency is different than the impedance of the impedance correction unit at the second frequency, such that the sum of the impedance of the second speaker unit and the impedance correction unit remains substantially constant over the frequency range.

15. The earphone device of claim 12, wherein the impedance correction unit is located at or near the Y-junction of the wires.

16. The earphone device of claim 12, wherein the impedance correction unit is located at or near the plug.

17. A system comprising:

an amplifier device configured to output an electrical signal; and an earphone device comprising:

a first speaker unit corresponding to a left channel, the first speaker unit including a first balanced armature transducer and a second balanced armature transducer to convert an electrical signal into an acoustic signal;

a second speaker unit corresponding to a right channel, the second speaker unit including a third balanced armature transducer and a fourth balanced armature transducer to convert an electrical signal into an acoustic signal;

an impedance correction unit, wherein the impedance correction unit is configured to:

receive the electrical signal, wherein the electrical signal defines a frequency range comprising a first frequency and a second frequency;

compliment an impedance of the first speaker unit such that a sum of an impedance of the impedance correction unit and the impedance of the first speaker unit at the first frequency is substantially similar to a sum of an impedance of the impedance correction unit and the impedance of the first speaker unit at the second frequency; and compliment an impedance of the second speaker unit such that sum of an impedance of the impedance correction unit and the impedance of the second speaker unit at the first frequency is substantially similar to a sum of an impedance of the impedance correction unit and the impedance of the fast speaker unit at the second frequency;

a crossover unit configured to convert the electrical signal into a first component of the electrical signal comprising a first frequency range and a second component of the electrical signal comprising a second frequency range;

a plug that interfaces with the amplifier;

a first wire corresponding to the left channel that couples the crossover unit to the plug;

a second wire corresponding to the right channel that couples the crossover unit to the plug;

a third wire and a fourth wire that couple the first speaker unit to the crossover unit; and a fifth wire and a sixth wire that couple the second speaker unit to the crossover unit, wherein the first and second wires are mechanically coupled to form a Y-junction of the wires, and wherein the crossover unit is positioned at or near the Y-junction of the wires.

18. The system of claim 17, wherein the impedance correction unit comprises a Zobel network circuit, and wherein the impedance correction unit is positioned at or near the Y-junction of the wires.

19. The system of claim 17, wherein the impedance correction unit comprises a Zobel network circuit, and wherein the impedance correction unit is positioned at or near the plug.

* * * * *